US006173771B1

(12) United States Patent
Eslinger et al.

(10) Patent No.: US 6,173,771 B1
(45) Date of Patent: Jan. 16, 2001

(54) APPARATUS FOR CLEANING WELL TUBULAR MEMBERS

(75) Inventors: David M. Eslinger, Broken Arrow, OK (US); Lawrence J. Leising, Sugar Land, TX (US)

(73) Assignee: Schlumberger Technology Corporation, Sugar Land, TX (US)

( * ) Notice: Under 35 U.S.C. 154(b), the term of this patent shall be extended for 0 days.

(21) Appl. No.: 09/123,968

(22) Filed: Jul. 29, 1998

Related U.S. Application Data

(60) Provisional application No. 60/067,944, filed on Dec. 8, 1997.

(51) Int. Cl.[7] ..... E21B 37/00

(52) U.S. Cl. ..... 166/173; 166/311

(58) Field of Search ..... 166/311, 312, 166/222, 223, 104, 173, 170; 15/104.095, 104.12, 104.13, 104.16

(56) References Cited

U.S. PATENT DOCUMENTS 812,361 * 2/1906 Pickles et al. ..... 15/104.12
1,705,451 * 3/1929 Taricco ..... 15/104.14
4,705,107 * 11/1987 Council et al. ..... 166/170
4,919,204 * 4/1990 Baker et al. ..... 166/223

* cited by examiner

*Primary Examiner*—David Bagnell
*Assistant Examiner*—Jennifer M Hawkins
(74) *Attorney, Agent, or Firm*—Robin C. Nava; John E. Vick

(57) ABSTRACT

A downhole cleaning tool (20) is suspended within a well tubular member (10) by coiled tubing (12) for the removal of deposits (29) within the tubular member (10). Tool (20) includes a hydraulic fluid motor (26) for rotating a combined fluid jetting and milling head (28). Fluid jetting and milling head (28) has a tapered body with a lower rounded nose (60). Embedded milling inserts or elements (62, 64) project outwardly from the tapered body and nose (60) to contact the deposit and are randomly spaced on head (28). A plurality of upper radial jets (70) extend above milling elements (62). Lower fluid jets or ports (78) extend from the lower rounded nose (60) of head (28). Power fluid from the coiled tubing (12) is divided at port (38) to the rotor bore (34) into a bypass fluid stream flowing through central bore (34) and a fluid power stream in annular passage (39) outside rotor (32) for rotation of rotor (32) and shaft (27) to rotate the fluid jetting and milling head (28).

15 Claims, 2 Drawing Sheets

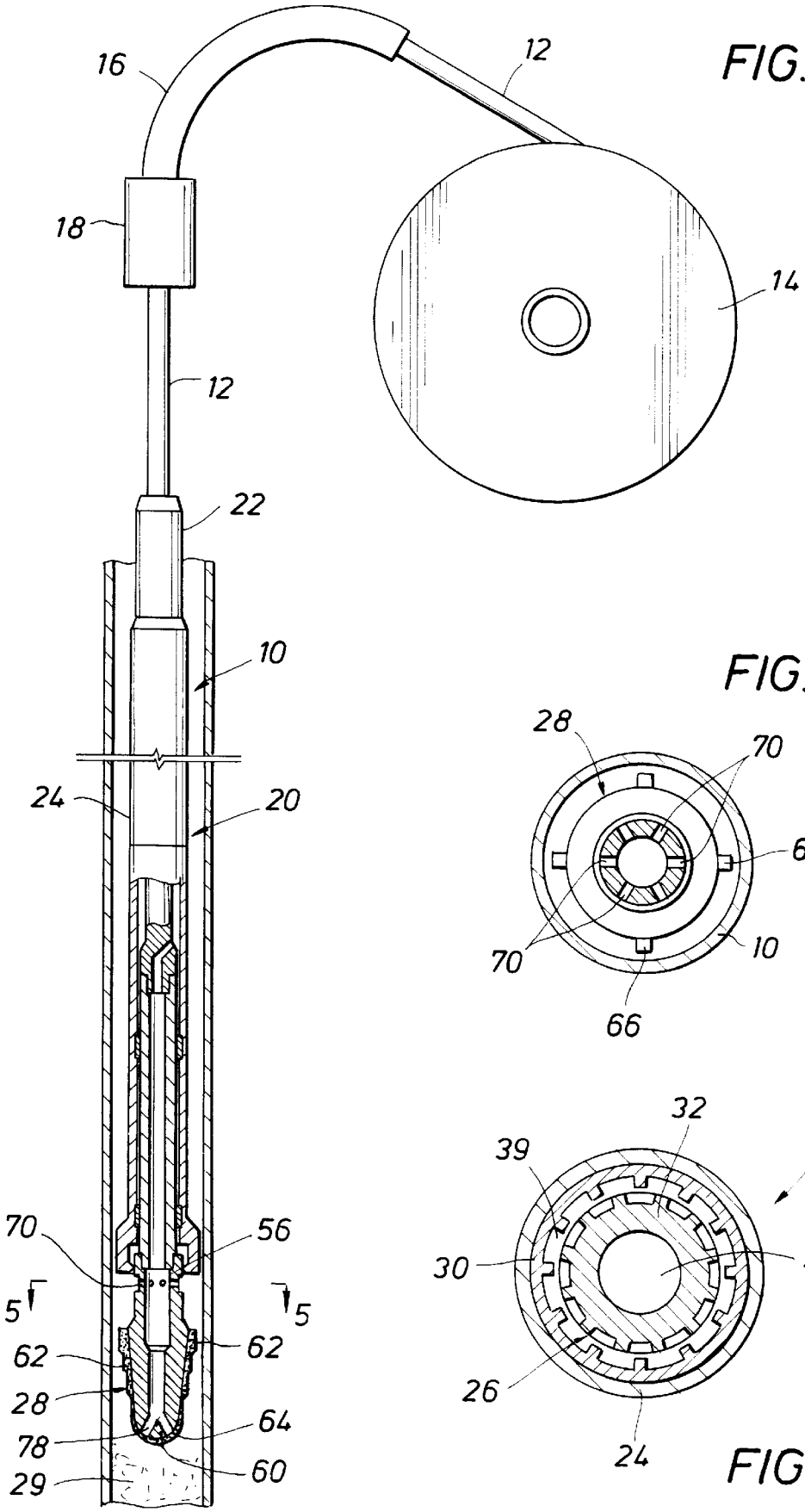
FIG. 1
FIG. 5
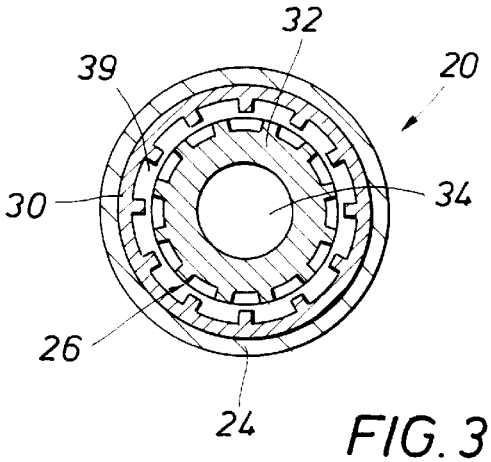
FIG. 3

APPARATUS FOR CLEANING WELL TUBULAR MEMBERS

REFERENCE TO RELATED PROVISIONAL APPLICATION

This application claims the priority of provisional application Ser. No. 60/067,944 filed Dec. 8, 1997.

FIELD OF THE INVENTION

This invention relates to apparatus for cleaning well tubular members downhole, and more particularly to a downhole cleaning tool having a rotary milling head with fluid discharge nozzles for cleaning deposits from the tubular bore.

BACKGROUND OF THE INVENTION

Downhole rotating jetting heads have been used to remove deposits from well tubular members. Fluid jetting heads driven by impulse motors, such as offset nozzles or turbines, tend to generate low drive torque. This makes the heads susceptible to stalling by deposit cuttings or by deposit bridges. Further, when the head stalls, no signal is given to surface that the head is not rotating. Further, jetting heads are most efficient when cleaning radially rather than axially, particularly for drilling through deposit bridges. Therefore, multiple runs into a well are often required to fully remove the deposits; first running a positive displacement motor (PDM) with a milling head to remove bridges followed by a run with a radial jetting tool to remove wall deposits.

U.S. Pat. No. 4,705,107 dated Nov. 10, 1987 shows a rotating cutting tool driven by a fluid turbine motor with fluid nozzles to assist in removing deposits from the tubular bore. However, spend fluid used for driving the turbine motor is utilized for the fluid nozzles and a flexible connection is provided between the cutting head and the fluid turbine motor which substantially limits the torque transmitted to the cutter. Further, no blades or cutting elements are provided on the lower end of the cutting tool for penetrating any bridge deposits.

It is desired that a milling head rigidly connected to the motor be provided with milling elements projecting downwardly from the lower end of the head along the axis of rotation for penetrating deposits bridging the tubular bore.

Further, it is desired that fluid jets be provided adjacent the upper end of the milling elements on the milling head to assist in the cleaning of the deposits from the tubular bore after milling with unspent power fluid being available for the fluid jets.

SUMMARY OF THE INVENTION

The present invention is directed to a downhole cleaning tool having a rotating milling head with fluid jet nozzles receiving power fluid. The power fluid is discharged radially from jet nozzles on a combined fluid jetting and milling head (jet/milling head) adjacent milling elements projecting from the head and removes deposits outside the hole drilled by the milling head. The milling elements on the milling head extend along the lower end of the milling head across the axis of rotation for drilling a hole through a deposit bridging the tubular bore and the fluid jet streams discharged from jet nozzles above the milling elements are highly effective in removing any deposits remaining after the milling action. Additional fluid jets may be provided adjacent the lower end of the milling head.

A fluid motor is utilized for rotating the jet/milling head and a major portion of the power fluid is normally directed to the fluid motor for rotating or driving the fluid motor. The remainder of the power fluid flows unimpeded to the jet nozzles for discharge radially at a relatively high velocity against the inner periphery of the adjacent tubular member. The spent fluid which was diverted to the fluid motor for rotation of the jet/milling head rejoins the power fluid downstream of the fluid motor for discharge from the jet nozzles with the power fluid.

Normally, if the jet/milling head is not stalled or milling, the pressure drop through the fluid motor is relatively low (100 psi) and the remainder of the pressure drop across the tool is across the nozzles. In the event the head begins to stall or to mill, the pressure drop across the fluid motor increases to about 400 psi, for example, providing an increase in total tool pressure drop at a constant flow rate. This gives a stall indication at surface and the flow rate may be reduced to acceptable levels. The increased pressure drop across the fluid motor develops significant torque, such as at least about 50 ft.-lbs., which should free the stuck head (followed by a pressure drop across the tool) or allow milling of a bridge.

Coiled tubing is normally used for servicing of wells to remove scale and other downhole deposits on the wells of the well tubular members. The cleaning fluid is injected in the coiled tubing and flows downwardly to the bottom hole assembly or tool which includes the fluid motor and jet/milling head. The power fluid is split between flow through the motor and flow through a bypass port through the rotor thereby giving improved speed control. The two split flows combine downstream of the motor and flow to the jetting nozzles. The amount of bypass flow is controlled by using properly sized orifices in the bypass passage to the motor. In the event the head stalls due to jamming or encountering a bridge, the available pressure drop across the motor (and therefore the torque) is limited by the pressure drop through the bypass port caused by the increased flow through the bypass port after stall.

The jet/milling head of a generally frusto-conical shape includes milling elements or inserts projecting from the outer surface of the milling head including the rounded lower end of the head and are particularly effective in breaking through a bridge across the tubular bore. Radially directed fluid discharge nozzles are positioned on the jet/milling head adjacent the upper ends of the milling elements for the radial discharge of high pressure cleaning fluid directly against the deposits in the tubular member after the milling elements have contacted the deposits. Fluid discharge nozzles are provided on the lower rounded end of the jet/milling head for the downward discharge of high velocity fluid against the deposits prior to engagement of the deposits by the milling elements. The lower nozzles are effective also for the transport of milled cuttings upwardly above the fluid jetting and milling head.

It is an object of the invention to provide a cleaning tool for cleaning deposits from a downhole tubular member which has a combined fluid jetting and milling head with high velocity jet nozzles positioned above projecting milling elements for removing the deposits from the tubular bore of the tubular member.

Another object of the invention is to provide a cleaning tool having a lower fluid jetting and milling head with milling elements projecting from the rounded lower end of the head and fluid discharge nozzles adjacent the lower end of the milling elements for the discharge of high velocity cleaning fluid directly against the deposits prior to engagement of the deposits by the milling elements.

A further object is to provide such a cleaning tool having a fluid motor for rotating the jet/milling head with the power fluid divided between a passage for driving the motor and a bypass passage through the rotor of the fluid motor thereby permitting power or unspent fluid to flow to the jet nozzles.

Other objects, features, and advantages will be apparent from the following specification and drawings.

BRIEF DESCRIPTION OF THE DRAWINGS

FIG. 1 is an elevational view, partly schematic, of the cleaning apparatus of the present invention showing a cleaning tool supported by coiled tubing downhole within a tubular member for cleaning deposits from the tubular bore;

FIG. 3 is a section taken generally along the line 3—3 of FIG. 2;

FIG. 5 is a section taken generally along the line 5—5 of FIG. 4.

DESCRIPTION OF THE INVENTION

Figure 2:
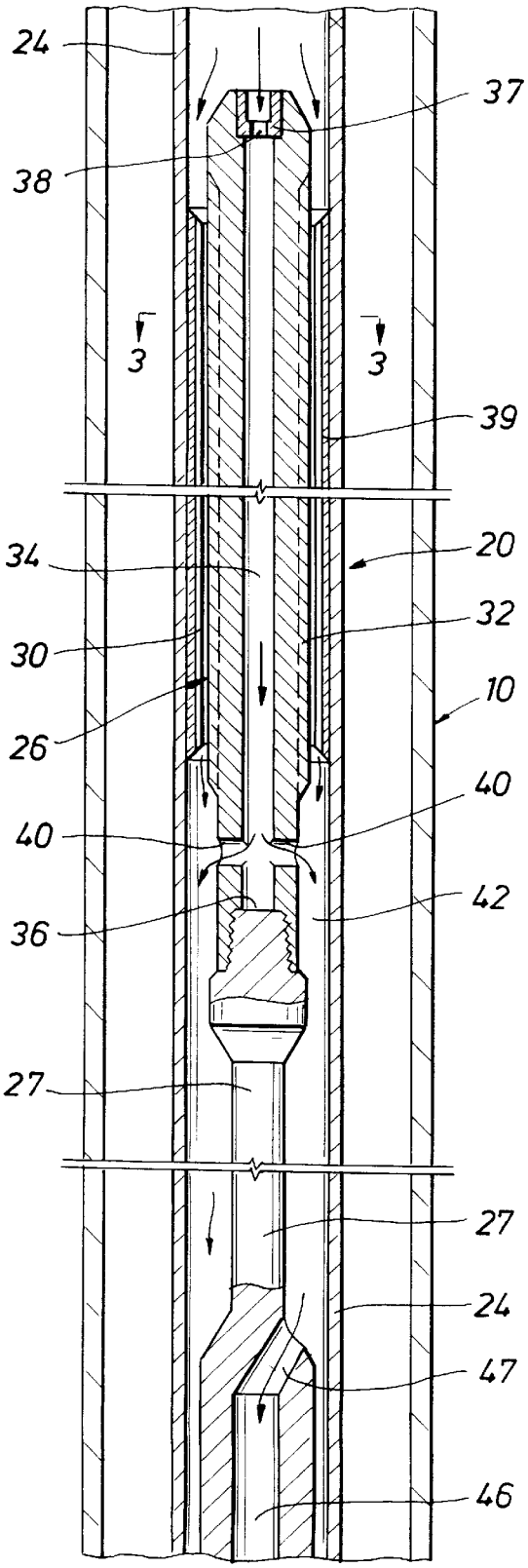
FIG. 2 is an enlarged sectional view of the upper end portion of the cleaning tool including the hydraulic fluid motor for rotating the cleaning tool.

Referring now particularly to FIG. 1, a well is illustrated having a casing 10 mounted within an earth formation. Various types of deposits may accumulate on the inner peripheral walls of the casing or tubular member 10 such as paraffin, silicates, carbonates, and sulphate, for example. Coiled tubing shown generally at 12 is normally used for servicing of wells. A reel 14 for the coiled tubing 12 stores the coiled tubing and permits unreeling of the coiled tubing 12 through a guide 16 extending to an injector 18 for inserting coiled tubing 12 downhole within the tubular member 10.

A cleaning tool generally indicated at 20 is connected by a suitable connector 22 to the lower end of coiled tubing 12. Tool 20 has an outer housing 24 and a suitable check valve (not shown) may be positioned within outer housing 24 to restrict backflow of fluids, as desired. Tool 20 includes a hydraulic fluid motor generally indicated at 26 having a shaft or mandrel 27 extending therefrom connected to a lower combined fluid jetting and milling head (jet/milling head) generally indicated at 28.

As shown in FIG. 2, hydraulic fluid motor 26 has an outer stator 30 secured to housing 24 and receiving a rotor 32 having a central bore 34 therethrough and closed at its lower end at 36 by shaft 28. Central bore 34 provides a bypass fluid passage for fluid to bypass motor 26 and has an upper inlet nozzle 37 defining a bypass port or opening 38 for central bore 34. An annular flow passage 39 is provided between rotor 32 and stator 30. Rotor 32 has fins or blades extending outwardly into flow passage 39 and contacted by the downward flow of power fluid in annular passage 39 of rotor 32 thereby to rotate rotor 32 and shaft 27. Thus, the flow of fluid flowing downwardly in coiled tubing 12 is divided adjacent the upper end of rotor 32 into bypassing fluid flowing through port 38 and central bore 34, and fluid flowing downwardly in annular passage 39 outside of rotor 32 and engaging fins or blades on rotor 32 extending into passage 39 for rotation of rotor 32. The bypass fluid entering bore 34 flows outwardly from bore 34 through ports 40 into the annulus 42 between shaft 27 and housing 24 where it joins the spent fluid flowing downwardly from annular passage 39 about rotor 32. The arrangement of fluid motor 26 is shown in FIG. 2 primarily schematically and various embodiments of fluid motors may be utilized in a satisfactory manner to provide bypass fluid.

Normally the fluid pressure drop through fluid motor 26 is relatively low, such as 100 psi, for example, and the remainder of the pressure drop occurs at the fluid discharge nozzles for jet/milling head 28. In the event the jet/milling head 28 stalls due to jamming or encountering a bridge across the tubular bore, a large fluid pressure drop occurs at the hydraulic motor 26 and an increased fluid flow occurs through the bypass passage 34.

It may be desirable in order to increase the torque for rotor 32 to provide an increased fluid flow to rotor 32 and a suitable valve member (not shown) responsive to a selected fluid pressure differential may be positioned within bypass port 38 and upon actuation of the valve member by an increased fluid pressure differential an increased fluid flow may be provided to annular passage 39 for rotating rotor 32. Upon an increase in the fluid pressure differential, the valve member would move to restrict the flow of fluid through bypass passage 34 thereby diverting most of the fluid through annular passage 39 outside rotor 32 for rotating rotor 32 and shaft 27 thereby to provide increased torque to fluid jetting and milling head 28. When head 28 becomes free, a decrease in circulation pressure occurs and the bypass valve member would return to its original position in which the predetermined fluid split is provided between bypass fluid moving through bypass passage 34 and power fluid for driving rotor 32.

Shaft 27 has a lower end portion 44 with a central bore 46 and fluid from annulus 42 flows through port 47 into central bore 46. Lower end portion 44 has an externally threaded lower end. Head 28 has an upper cap 48 and an internally threaded sleeve 52 extending upwardly from cap 48 is threaded onto shaft 27 for rotation therewith. Shaft 27 is mounted for relation on spaced bearings 51 between shaft 27 and outer housing 24. Upper bearing 51 blocks the downward flow of fluid in the annulus between shaft 27 and outer housing 24. Outer housing 24 has an end drift ring or hood 50 threaded thereto for receiving end cap 48 of head 28 therein. Hood 50 has an inwardly extending guide 53 adjacent shoulder 55 for contacting end cap 48 to minimize eccentric movement of head 28 during rotation thereof.

Fluid jetting and milling head 28 has a bore 56 in a tapered body extending to a rounded or hemispherical end nose 60 on the lower end of head 28. Bore 56 forms a continuation of bore 46. Fluid jetting and milling head 28 is generally frusto-conical in shape to define a tapered outer surface 59 extending upwardly from rounded end nose 60. A plurality of randomly spaced milling elements or inserts 62, preferably formed of tungsten carbide, are embedded in head 28 and project outwardly from outer surface 59 of head 28. A plurality of lowermost milling inserts 64 are embedded in rounded nose 60 adjacent the rotational axis of head 28 and project outwardly from the outer surface of nose 60 thereof to mill effectively a hole in a deposit bridging the tubular bore.

Figure 4:
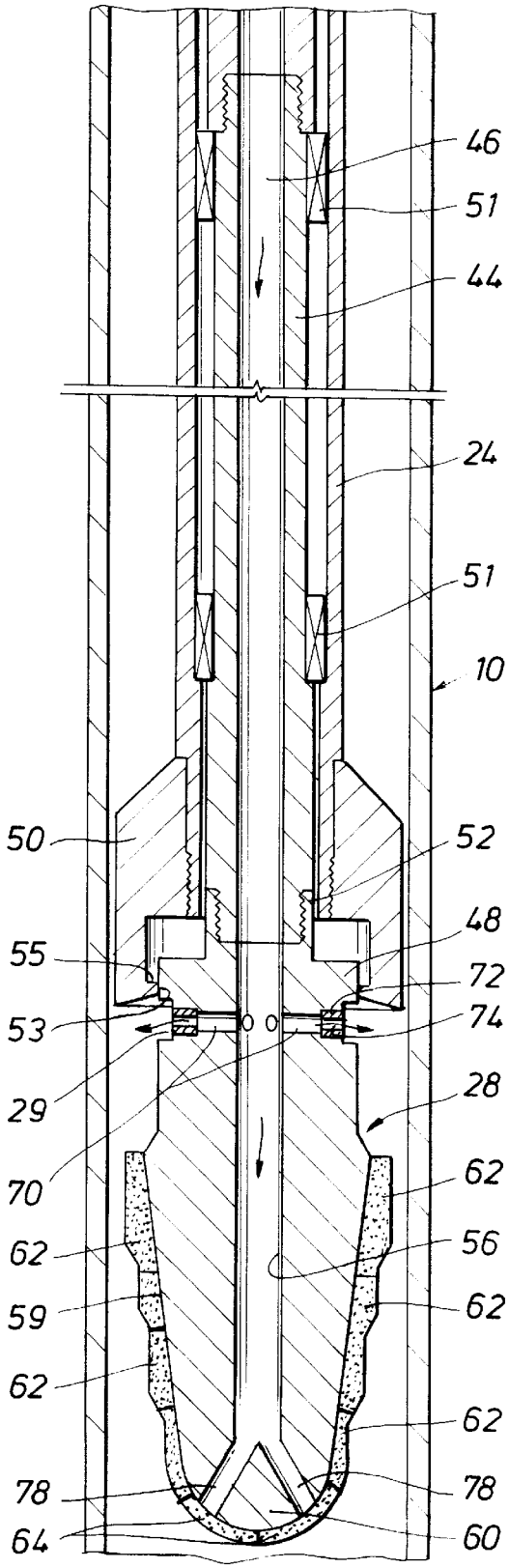
FIG. 4 is an enlarged sectional view forming generally a continuation of FIG. 2 and showing the lower end portion of the cleaning tool including a combined fluid jetting and milling head rotated by the fluid motor.

Referring to FIGS. 4 and 5, radially extending fluid passages 70 extend radially through jet/milling head 28 from bore 56 for a radial discharge of fluid directly against the deposit 29. While six fluid passages 70 are shown in the drawings, any desired number of fluid passages 70 may be provided, and a pair of opposed fluid passages 70 is preferred. A discharge nozzle 72 having a port or jet 74 is threaded within each of the lateral passages 70 above milling elements 62. Nozzles 72 are positioned closely adjacent drift ring 50 with the centerline of nozzles 72 preferably about ¼ inch below drift ring 50. Satisfactory results may be obtained with the centerline of ports 74 spaced vertically as much as about 2 inches from drift ring 50. Nozzles 72 are preferably spaced laterally from the inner periphery of tubular member 10 a distance between 2 and 10 times the diameter of the port 74. Thus, a spacing between about ⅜ inch to 1¼ inch is preferred.

A pair of lower discharge ports 78 communicating with bore 56 are provided adjacent lower milling elements 64. Ports 78 are preferably positioned at a twenty (20) degree angle to the longitudinal axis of tool 20 for discharging a fluid jet against the deposit 29 in a downward direction from milling elements 64. An angle between about ten (10) degrees and forty-five (45) degrees with respect to the longitudinal axis would function in a satisfactory manner. Suitable nozzles (not shown) may be positioned within ports 78 if desired. While two ports 78 are shown in the drawings, a single port 78 is preferable. Lower milling elements 64 extend over lower nose 60 so that direct contact is made by milling elements 64 at the center of any deposit bridge.

As an example of a satisfactory cleaning tool 20, a flow rate of 1.3 barrels per minute (bpm) was provided with two nozzles 72 having a port 74 of 0.12 inch diameter. A single lower port 78 of about 0.125 inch diameter was utilized. A normal nozzle pressure of about 1700 psi was provided for nozzles 72. The fluid motor 26 had a diameter of about 2⅛ inches and was rotated at about 325 revolutions per minute (rpm). The diameter of head 28 was 1.50 inches and the maximum milling diameter including milling elements 62 was 1.75 inches. Ring 50 for mounting of head 28 was about 2.75 inches in diameter. A tool 20 in accord with the above was found to remove effectively soft and hard deposits from the tubular bore of tubular member 10. Head 28 as shown in the drawings is spaced a relatively small lateral distance from tubular member 10. In most instances, head 28 would be spaced a greater distance from tubular member 10.

It is apparent that various fluid nozzles may be provided above and below the milling elements 62 and 64 on fluid jetting and milling head 28. The number and port sizes of the nozzles would vary dependent primarily on the type of deposit to be removed from the tubular bore. Likewise, the amount of bypass fluid bypassing rotor 32 through rotor bore 32 would vary dependent primarily on the type of deposit to be removed. A plurality of nozzles 37 having different sizes of ports 38 may be provided with a desired port size selected for a desired amount of bypass fluid.

While preferred embodiments of the present invention have been illustrated in detail, it is apparent that modifications and adaptations of the preferred embodiments will occur to those skilled in the art. However, it is to be expressly understood that such modifications and adaptations are within the spirit and scope of the present invention as set forth in the following claims.

What is claimed is:

1. A cleaning tool for removing a deposit from the bore of a tubular member having a fluid motor for rotating an output shaft and a drive shaft connected to said output shaft for rotation therewith;

an improved combined jetting and milling head on said tool operatively connected to said drive shaft for rotation and having a lower nose constructed and arranged to penetrate a deposit bridging the bore of said tubular member, said combined fluid jetting and milling head having a fluid passage in fluid communication with said fluid motor said fluid passage terminating in at least one fluid discharge jet and a plurality of milling elements extending outwardly from said head including said lower nose for engaging said deposit, and a second at least one fluid discharge jet adjacent the upper end of said head in fluid communication with a fluid passage to receive fluid from said fluid motor for discharge from said jet above said milling elements for removal of said deposit from the tubular member, wherein a passage is provided through said fluid motor to deliver unspent fluid to said discharge jets.

2. In the cleaning tool as set forth in claim 1 wherein said fluid discharge jet is provided adjacent said milling elements in fluid communication with said central bore of said rotor to receive unspent power fluid therefrom for discharge from said jet against the deposit on the tubular member.

3. In the cleaning tool as set forth in claim 1 wherein said improved combined fluid jetting and milling head has a generally frusto-conical outer surface and said lower nose has a rounded lower end surface of a generally hemispherical shape, and said milling elements are embedded in said head and project outwardly from said frusto-conical outer surface and said nose.

4. In cleaning tool as set forth in claim 1 wherein said at least one fluid discharge jet is provided in said nose for discharge of cleaning fluid downwardly against said deposit prior to engagement of said milling elements with said deposit.

5. A cleaning tool suspended from a surface location for removing deposits from a downhole tubular member comprising:

a hydraulic fluid motor having an inner rotor and outer stator arranged in concentric relation and defining a fluid flow passage therebetween for the downward flow of power fluid to rotate the rotor, said rotor having a central bore and an upper entrance port for the central bore for defining a fluid bypass passage to permit power fluid to bypass the motor;

a drive shaft connected to said rotor for rotation with said rotor; and a combined fluid jetting and milling head on a lower end of the tool operatively connected to said drive shaft for rotation, said fluid jetting and milling head having a plurality of spaced milling elements projecting from the outer surface of said milling head, and a fluid discharge jet adjacent the upper end of said head receiving fluid from said fluid motor for discharge above said milling elements for removal of said deposit.

6. The cleaning tool as set forth in claim 5 wherein said combined fluid jetting and milling head has a generally frusto-conical outer surface and said lower nose has a rounded lower end surface of a generally hemispherical shape, and said milling elements are embedded in said head and project outwardly from said frusto-conical outer surface and said nose.

7. The cleaning tool as set forth in claim 5 wherein a fluid discharge jet is provided in said nose for discharge of cleaning fluid downwardly against said deposit prior to engagement of said milling elements with said deposit.

8. The cleaning tool as set forth in claim 5 wherein said fluid jetting and milling head has a lower nose defining a rounded lower end surface, and milling elements project outwardly from said lower nose at the rotational axis of said tool for drilling a hole through a deposit bridging the bore of said tubular member.

9. Apparatus for removing deposits from a downhole tubular member comprising:

a cleaning tool positioned downhole in the tubular member adjacent a deposit to be removed;

a coiled tubing string extending from a surface location having a lower end connected to the cleaning tool and supporting the cleaning tool for movement along the tubular member; said cleaning tool having:

a hydraulic fluid motor driven by power fluid flowing downwardly through said coiled tubing;

a drive shaft extending from said fluid motor and rotated thereby;

a fluid jetting and milling head on the lower end of said tool operatively connected to said drive shaft for rotation and having a plurality of milling elements projecting outwardly for engaging a deposit in the tubular bore defined by the tubular member said fluid jetting and milling head having a fluid passage in fluid communication with said fluid motor, said fluid passage terminating in at least one fluid discharge jet, wherein a passage is provided through said fluid motor to deliver unspent fluid to said discharge jets; and a fluid discharge jet adjacent the upper ends of said milling elements receiving fluid from said fluid motor for discharge above said milling elements for removal of said deposit.

10. Apparatus as set forth in claim 9 wherein said fluid jetting and milling head has a lower nose defining a rounded lower end surface, and milling elements project outwardly from said lower nose at the rotational axis of said tool for drilling a hole through a deposit bridging the bore of said tubular member.

11. Apparatus as set forth in claim 10 wherein said fluid jetting and milling head has a generally frusto-conical outer surface and said lower nose has a rounded lower end surface of a generally hemispherical shape, and said milling elements are embedded in said head and project outwardly from said frusto-conical outer surface and said nose.

12. Apparatus as set forth in claim 9 wherein said at least one fluid discharge jet is provided in said nose for discharge of cleaning fluid downwardly against said deposit prior to engagement of said milling elements with said deposit.

13. Apparatus as set forth in claim 9 wherein said tool has an outer housing in which said drive shaft and said head are mounted for relative rotation, and a hood is mounted on the lower end of said housing; said head having an upper end portion received within said hood and contacting said hood to minimize relative eccentric rotation of said head.

14. Apparatus as set forth in claim 13 wherein said fluid discharge jet is mounted on said upper end portion of said head below said hood.

15. Apparatus as set forth in claim 13 wherein a pair of radially directed opposed fluid jets are mounted on said upper end portion of said head below said hood and above said milling elements.

* * * * *